United States Patent [19]

Jarrett

[11] 4,086,969

[45] May 2, 1978

[54] CROWD FOR KELLY BAR

[75] Inventor: William E. Jarrett, West Sacramento, Calif.

[73] Assignee: Zonver Jarrett Foundation Drilling Co., Inc., Sun Valley, Calif.

[21] Appl. No.: 742,909

[22] Filed: Nov. 18, 1976

[51] Int. Cl.[2] ..... B23Q 5/00

[52] U.S. Cl. ..... 173/149; 279/4

[58] Field of Search ..... 173/149; 214/338; 226/162–166; 254/29 R, 29 A, 30, 31; 279/4, 121

[56] References Cited

U.S. PATENT DOCUMENTS

| | | | |
|---|---|---|---|
| 2,090,854 | 8/1937 | Timbs | 173/149 |
| 2,188,107 | 1/1940 | Caldwell et al. | 173/149 |
| 2,570,308 | 10/1951 | Beeth | 173/149 |
| 2,586,784 | 2/1952 | Capp et al. | 173/149 X |
| 2,730,331 | 1/1956 | Harinck | 173/149 |
| 3,094,312 | 6/1963 | Woolgar | 173/149 X |
| 3,212,591 | 10/1965 | Tucker | 173/149 |
| 3,792,869 | 2/1974 | Braun | 173/149 X |

*Primary Examiner*—Lawrence J. Staab
*Attorney, Agent, or Firm*—Huebner & Worrel

[57] ABSTRACT

In a heavy duty drilling machine having a boring head for rotating a kelly bar, a crowd frame supported above the boring head by hydraulic rams, a crowd supported in the crowd frame and means supported by the crowd frame to engage the crowd with the kelly bar to transfer the entire weight of the drilling machine and crowd frame on to the kelly bar to increase the down pressure on drilling means at the lower end of the kelly bar; the kelly bar being disengageable during operation to permit drilling without use of the crowd. There is also provided a stabilizer to prevent twisting of the crowd frame during rotation of the kelly bar when the crowd is engaged.

16 Claims, 9 Drawing Figures

CROWD FOR KELLY BAR

BACKGROUND OF THE INVENTION

The invention relates to heavy drilling equipment in which kelly bars are used, the kelly bars having drilling means, such as augers or bucket drills, on their lower ends. When holes are drilled in hard foundations with such equipment, it is advantageous to apply additional weight to the drill to facilitate the drilling. In the prior art crowds have been used to engage the kelly bar whereby the weight of the drilling equipment, including the boring head, has been applied to the drill. In these prior crowds, it was required that torque also be applied directly to the crowd as well as to the kelly bar. In addition, where a crowd was installed, it was typically permanently engaged so that the drilling culd not be accomplished with the crowd disengaged and the additional weight not being applied.

SUMMARY OF THE INVENTION

In the present invention the entire weight of the boring head and its supporting frame is applied to the kelly bar when the crowd is in clamping engagement with the kelly bar. Additional weights may be added to the drilling machine to increase the weight on the drill up to 40,000 pounds, for example. The crowd is adapted to remain in place in association with the kelly bar when in non-clamping or disengaged open position.

It is an object of the present invention to provide an improved crowd for transferring the weight of the drilling machine to the kelly bar and drill.

It is another object of the present invention to provide a crowd, as described in the previous paragraph, that can be engaged with the kelly bar when needed and disengaged from the kelly bar, remaining in place, when the additional weight is not needed.

It is still another object of the invention to provide a crowd, as described in previous paragraphs, in which no torque is applied to the crowd except by the kelly bar when it is engaged during the drilling operation.

It is a further object of the invention to provide a crowd, as described in the previous paragraphs, in which the crowd will accommodate kelly bars of different sizes and shapes.

It is a still further object of the invention to provide a stabilizer for a crowd supporting frame to prevent the twisting of the frame. Such twisting may typically occur where friction develops on supporting rollers within the frame so as to tend to apply a twisting torque thereto.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes.

DESCRIPTION OF THE PREFERRED EMBODIMENTS

Figure 1:
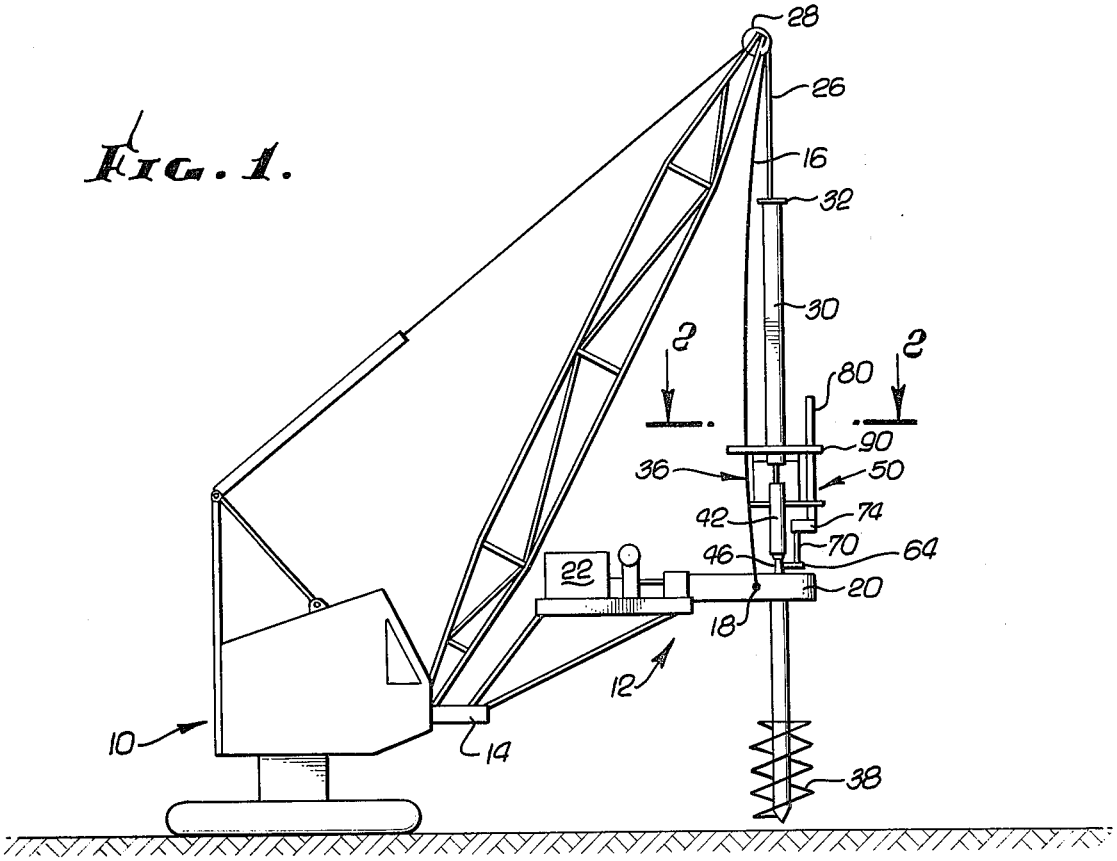
FIG. 1 is a side elevational view of a heavy duty drilling machine employing a crowd and stabilizer according to the invention.

Referring again to the drawings, in FIG. 1 there is shown a crane, generally designated as 10, supporting a heavy duty drilling machine, generally designated as 12. The drilling machine is pivotally mounted at 14 on the crane and is further vertically supported by the cables 16 extending over the top of the crane and connected at their lower ends 18 to the boring head 20. The boring head encloses a driving ring gear, not shown, which in turn is typically rotatably driven by a diesel engine 22.

A cable 26 extends over the main crane pulley 28 and at the lower end of the cable is a swivel, not shown, in which is attached a kelly bar 30. At the top of the kelly bar, below the swivel, is a horizontal plate 32. The kelly bar 30 is typically in the shape of a rectangular prism, and is raised and lowered by means of the cable 26.

The kelly bar extends downwardly through a crowd frame, generally designated as 36, in which it rotates and extends through the boring head 20 in which it is driven in rotation. At its lower end is an auger 38.

Figure 3:
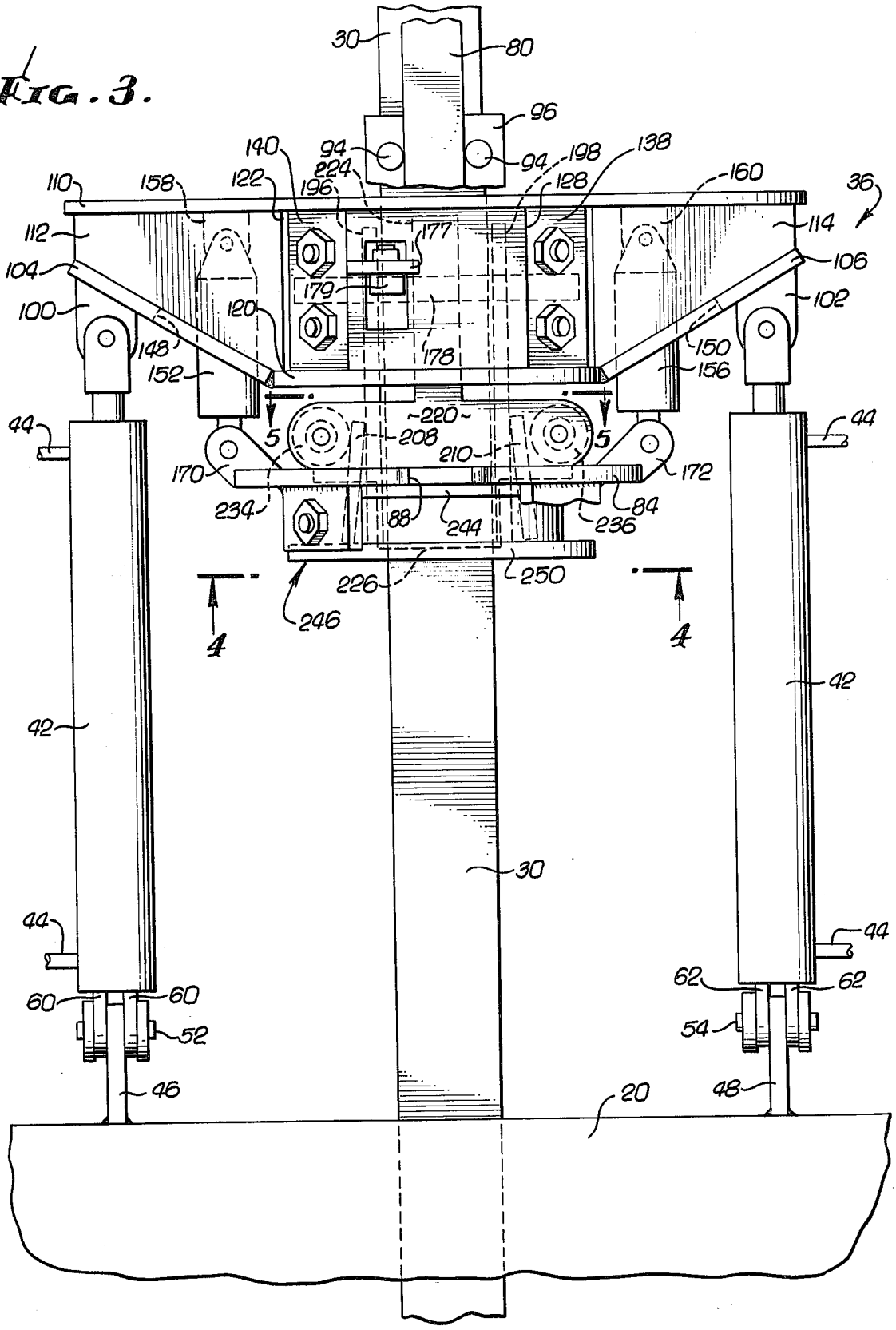
FIG. 3 is an elevational view taken substantially along the lines 3—3 in FIG. 2.

The crowd frame, as best seen in FIG. 3, is supported above the boring head 20 by a pair of hydraulic rams 42, the hydraulic rams having hydraulic fluid connections at 44. The lower ends of the rams are pivotally connected to the supports 46 and 48 by pins 52 and 54 extending through pairs of ears 60 and 62, respectively, on the lower end of the rams.

Figure 2:
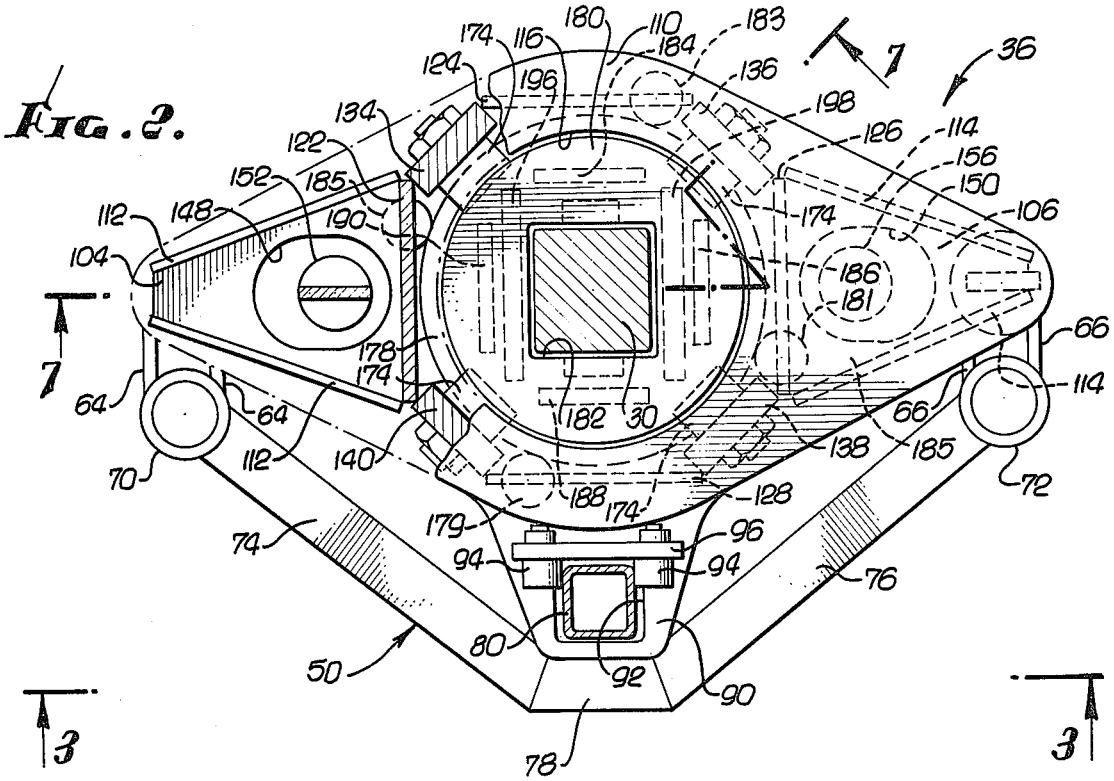
FIG. 2 is a plan view taken along the lines 2—2 in FIG. 1 and rotated 90°.

As best seen in FIGS. 1–3, also connected to the boring head by vertical supports 46 and 48 is a stabilizer, generally designated as 50. At the lower ends of the stabilizer there are horizontally extending plates 64 and 66 which are also pivotally secured to the supports 46 and 48, respectively. Extending upwardly from the plates 64 and 66 are a pair of generally parallel cylindrical tubes 70 and 72. At the upper ends of the tubes 70 and 72 are horizontally extending bars 74 and 76 which are joined by a horizontal bar 78 below and outwardly of the frame 36. Secured to the bar 78 is a rectangular rod 80 extending upwardly adjacent the frame 36.

As best seen in FIGS. 1, 3, 4 and 6, the crowd frame 36 has at its lower end a lower frame member or ring 84, from which extends a protrusion 86 having a rectangular notch 88 therein, and in which extends the rectangular rod 80. Best seen in FIGS. 1 and 3, at the upper portion of the crowd frame 36 is a horizontal, protruding guide 90. It has a rectangular opening 92 therein in vertical alignment with the notch 88, the square rod 80 extending through the opening 92. Secured to a vertical guide supporting plate 96, extending through the guide 90, are two horizontally mounted rollers 94, which are adapted to rotate on and guide the rod 80 as the crowd frame 36 is moved upwardly and downwardly, as will be explained.

The upper ends of the rams 42, FIGS. 1–3, are secured to ears 100 and 102, depending from inclined supports 104 and 106, respectively, of the upper portion of the crowd frame. The supports 104 and 106 are secured at their upper and outer ends to upper crowd frame plate 110, as best seen in FIG. 3, by means of plates 112 and 114, respectively. The plate 110 is of approximate oval shape, as seen in FIG. 2, and has a central cylindrical opening 116 therethrough.

Figure 6:
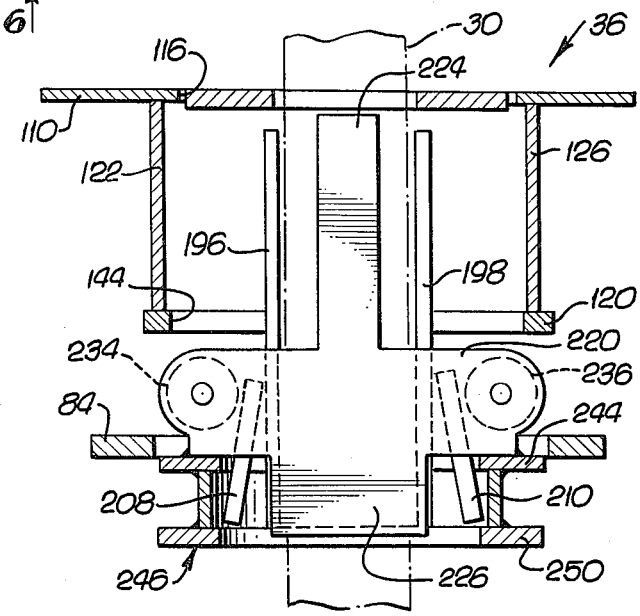
FIG. 6 is a partially cross-sectional elevational view taken substantially along the lines 6—6 in FIG. 5.
Figure 7:
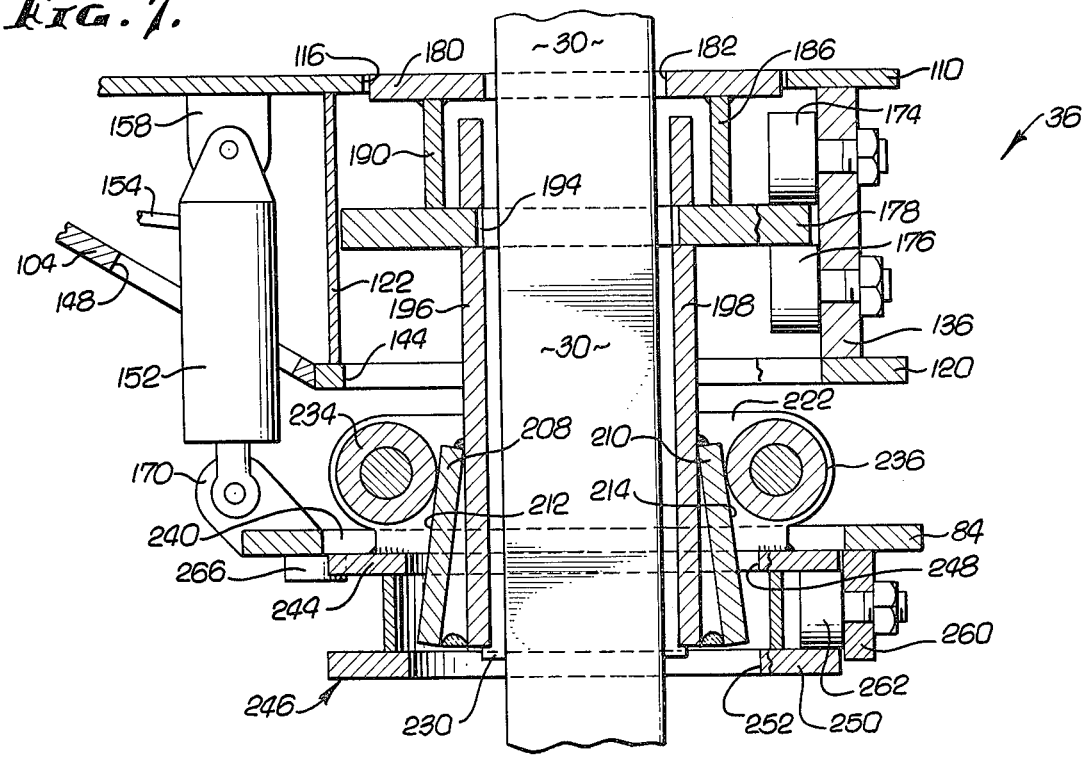
FIG. 7 is a cross-sectional view taken substantially along the lines 7—7 in FIG. 2, showing the crowd disengaged.

As shown in FIGS. 3 and 7, the supports 104 and 106 are connected at their lower ends to a horizontal plate 120. The plate 120 is connected to the plate 110 by vertical supports 122, 124, 126 and 128, as best seen in FIGS. 2 6 and 7. It is also connected by four vertical, circumferentially spaced, roller supports 134, 136, 138 and 140, shown in FIGS. 2, 3 and 7. Inwardly of the various vertical supports, the plate 120 has a central cylindrical opening 144. The lower end, not shown, of the guide support plate 96 is welded to the plate 120.

As best seen in FIGS. 2, 3 and 7, the inclined supports 104 and 106 have generally elliptical openings 148 and 150, respectively, through which extend a pair of vertical second rams 152 and 156, the rams being connected at their upper ends by ears 158 and 160, respectively, to the upper plate 110, and they are connected at their lower ends to the lower frame ring 84 by means of ears 170 and 172, respectively. The rams 152, 156 are supplied with hydraulic fluid through lines 154.

As seen in FIGS. 2 and 3, on each of the vertical roller supports 134, 136, 138 and 140 are a pair of vertically spaced, horizontally mounted rollers 174 and 176. Supported for rotation between the four sets of rollers 174 and 176 is a ring plate 178. Four horizontal ears 177, only one being shown, FIG. 3, are respectively mounted on the vertical four supports 134, 136, 138, 140. Each of four vertically mounted, circumferentially spaced rollers 179, 181, 183 and 185 depend from the ears 177 and center the ring 178, rotating on its circumferential edge.

A centrally positioned upper cylindrical plate 180, within the opening 116 in the upper plate 110, has a rectangular opening 182 to receive the kelly bar. It is supported for rotation on the plate 178 by four spaced, vertical plates 184, 186, 188 and 190. These plates are welded to plate 180 on their upper ends and rest on the ring 178 for rotation therewith. The purpose of the plate 180 is to stop the kelly bar and the plate 32 at their lowest possible positions.

Figure 9:
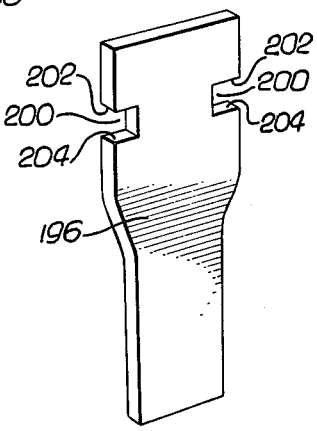
FIG. 9 is a perspective view of a crowd gripping plate.
Figure 5:
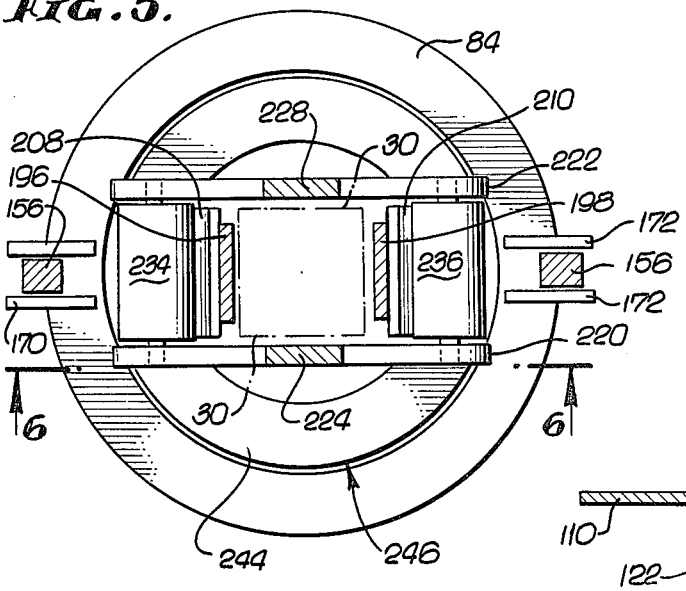
FIG. 5 is a plan view taken along the lines 5—5 in FIG. 3.
Figure 8:
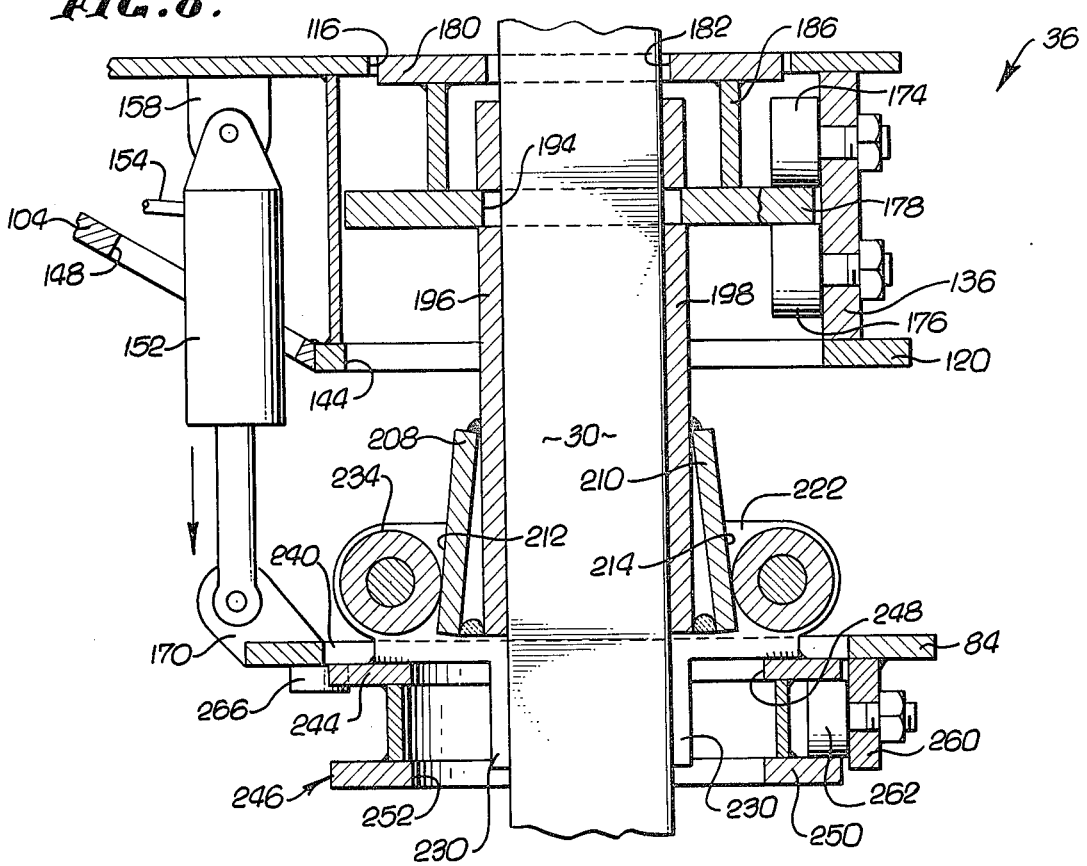
FIG. 8 is a view similar to that in FIG. 7 showing the crowd engaged with the kelly bar.

As shown in FIGS. 7, 8 and 9, the ring 178 has a central rectangular opening 194 to receive two identical crowd gripping or bearing plates 196 and 198. The crowd plates extend vertically along two opposite sides of the kelly bar and are spaced therefrom when disengaged and, as shown in FIG. 8, are in gripping contact with the kelly bar during engagement. Cut into the crowd plates at opposite upper edges are rectangular notches 200, of which upper shoulders 202 ride on top of the plate 178 and lower shoulders 204 extend thereunder to vertically support the plates and to permit their horizontal movement toward and away from the kelly bar. Thus, when the kelly bar rotates, the plates 198 and 196 rotate loosely therewith when disengaged, and tightly when engaged, the plate 178 rotating within the rollers 174 and 176 and on the rollers 179, 181, 183, and 185.

At the lower end of the crowd plates, outwardly thereof, are two identical cam follower plates 208 and 210. The upper end of the cam followers are welded in contact with the crowd plates and the lower ends of the cam followers are also welded thereto but spaced therefrom to provide downwardly tapering cam follower surfaces 212 and 214.

As best seen in FIGS. 3–8, outwardly of the kelly bar on opposite sides thereof, adjacent the sides facing the crowd plates, are two horizontally spaced vertical cam mounting plates 220 and 222. The plates 220, 222 have upwardly extending centering bars 224, 228, and downwardly extending centering portions 226, 230, extending along the kelly bar. Adjacent the plates' horizontal ends are spaced, horizontally mounted cam rollers 234 and 236, positioned to roll upwardly and downwardly on cam follower faces 212 and 214, respectively.

The plates 220, 222 extend downwardly through a cylindrical opening 240 in the lower frame ring 84 and are welded to an upper cylindrical flange 244 of a drum, generally designated as 246. The flange 244 has a cylindrical opening 248, and a corresponding flange 250 at the lower end of the drum has a corresponding cylindrical opening 252, the plate portions 226, 230 and the kelly bar extending through the openings.

Figure 4:
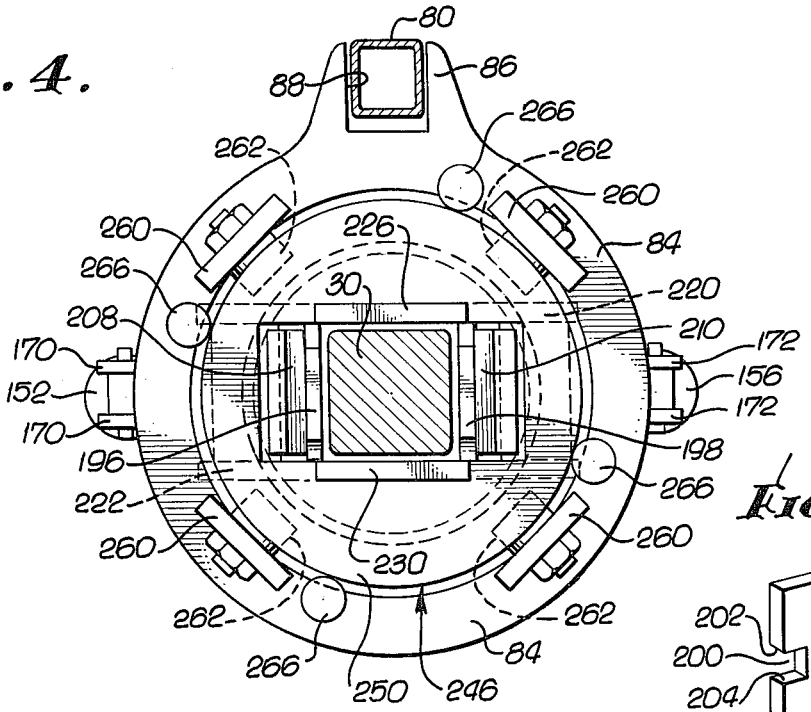
FIG. 4 is a bottom plan view taken along the lines 4—4 in FIG. 3.

Depending from the ring 84 are four circumferentially spaced roller mounting ears 260, each having an inwardly directed roller 262 horizontally mounted thereon. The roller surfaces extend between the drum flanges 244 and 250 so as to vertically support the drum, the cam mounting plates and the cam rollers 234 and 236 for horizontal rotation with the kelly bar. As shown in FIGS. 4, 7 and 8, the drum 246 is centered by four circumferentially spaced, vertically mounted rollers 266 depending from the flange 84, the rollers being in centering contact with the circumferential edge of the flange 244 of the drum.

In operation, the kelly bar 30 is rotatably driven within the boring head and it rotates the ring 180, the ring 178, the crowd bearing plates 196 and 198, the cam followers 208 and 210, the cams 234, 236, and the drum 246. In FIG. 7 the crowd is shown in its disengaged position, the drilling operation being able to proceed without engagement.

When it is necessary to apply more weight to the drilling means because of a hard drilling environment, the weight of the drilling machine including the boring head and the crowd frame, and additional weights added to the boring head, may be applied to the drill by engagement of the crowd with the kelly bar. To engage the crowd, as best seen in FIGS. 1 and 3, the hydraulic rams 42 are extended by pressure through the lines 44 so as to raise the crowd frame to its maximum height above the boring head 20. Next, as seen in FIGS. 7 and 8, the second hydraulic rams 152, 156 are pressurized through the lines 154 to move the lower frame ring 84, the drum 246 and the cam support plates 220, 222 downwardly with respect to the upper frame plate 110. This movement causes the cam rollers 234 and 236 to move against the cam follower faces 212 and 214, moving the crowd bearing plates horizontally into gripping contact with two opposite surfaces of the kelly bar 30.

In FIG. 7, where the crowd plates are fully opened, there is a space of about ¼ inch between each plate and the kelly bar, and if moved totally inwardly in the absence of the kelly bar they would be a distance apart of ½ inch less than the kelly bar width. Thus, as indicated in FIG. 8, the crowd plates are fully tightened when the cams are about three-quarters of the way down the surfaces of the cam followers.

After the crowd is closed upon the kelly bar, the entire weight of the equipment is then in position to act on the drill. As the drilling proceeds, pressure is released from the hydraulic rams 42 allowing the crowd frame to move downwardly with the kelly bar. When the rams 42 are fully retracted, then the second rams 152 are retracted to raise the cams and disengage the crowd from the kelly bar. To proceed with the drilling, the rams 42 are again extended to raise the crowd frame as high as possible and the rams 152 are again extended to close the crowd on the kelly bar to again apply the weight to the drilling means. The cycle is repeated during the drilling operation as long as the additional weight is necessary.

During rotation of the crowd-engaged kelly bar, friction may develop in the various rollers to tend to twist the crowd frame on its ram supports. Such twisting is prevented by the stabilizer rod 80, fitted to the frame and secured by the stabilizer parts to the boring head 20.

The invention and its attendant advantages will be understood from the foregoing description and it will be apparent that various changes may be made in the form, construction and arrangements of the parts of the invention without departing from the spirit and scope thereof or sacrificing its material advantages, the arrangements hereinbefore described being merely by way of example. I do not wish to be restricted to the specific forms shown or uses mentioned except as defined in the accompanying claims, wherein various portions have been separated for clarity of reading and not for emphasis.

I claim:

1. In a heavy duty drilling machine, a generally vertical kelly bar adapted for rotation and having drilling means on its lower end, said kelly bar being a rectangular prism, a boring head of a drilling machine adapted to receive said kelly bar therethrough and to rotate the kelly bar, a crowd frame above said boring head supported by first hydraulic rams having upper ends connected to the frame and lower ends connected to the boring head, a crowd supported vertically in said frame so as to be associated with said kelly bar, the improvement comprising:

means supported by the crowd frame to engage the crowd with the kelly bar to transfer the entire weight of the drilling machine and crowd frame onto the kelly bar to increase the down pressure on the drilling means, said means to engage being adapted to disengage the crowd from the kelly bar, said means to engage including cams and cam followers, said crowd including two elongated plates extending vertically on opposite sides of said prism, and being movable horizontally by said cams and cam followers, said plates being horizontally spaced from said two opposite sides when disengaged and being in gripping contact with said two opposite sides when engaged, said cam followers being two plates, each being secured to a respective said elongated plate outwardly thereof, said cam followers tapering downwardly so as to have outer faces thereof a greater horizontal distance from said elongated plates at their lower ends than at their upper ends, said cams being two cam rollers, each being positioned outwardly of and adjacent a respective outer follower face, said cams being supported by means including a non-rotating lower frame member of said crowd frame, means supporting said lower frame member in said crowd frame and being adapted to move said lower frame member and said cams upwardly and downwardly, said cams being adapted to be rotated with the kelly bar, said cams being adapted to engage said follower faces in pressure contact as they are moved downwardly so as to move said elongated crowd plates horizontally into gripping engagement with said kelly bar and said cams being adapted to be disengaged from said follower faces as they are moved upwardly so as to free said crowd plates from said kelly bar.

2. The invention according to claim 1 in which:

said means supporting are second hydraulic rams connecting an upper portion of said crowd frame with said lower frame member.

3. The invention according to claim 2 in which:

said lower frame member includes a non-rotating horizontally disposed ring plate having a cylindrical opening therethrough, said second rams being connected at their lower ends to said ring plate, roller supports depending from said ring plate, inwardly extending horizontally mounted rollers having shafts fixed in said roller supports, said means including comprising a rotatable horizontal drum below said ring plate and having a central opening therethrough aligned with said cylindrical opening in said ring plate, said kelly bar extending through said last openings, upper and lower horizontal cylindrical flanges forming circumferential marginal portions of said drum, said inwardly extending rollers being between said flanges to vertically support said drum for horizontal rotation, the extension and retraction of said second rams being adapted to respectively lower and raise said drum and said cams to respectively move said crowd plates into gripping engagement with said kelly bar and to free said crowd plates from said kelly bar.

4. The invention according to claim 1 in which:

said crowd plates are supported vertically adjacent an upper end of said crowd frame on a horizontal ring having a centrally positioned rectangular opening therein, said ring being supported for rotation on horizontally mounted rollers, said rollers being supported on fixed horizontal shafts on said crowd frame outwardly of said ring, the rollers making supporting contact with the ring on horizontal surfaces thereof adjacent its circumference, said crowd plates having notches in opposite edges thereof adjacent their upper ends, said crowd plates extending through said ring opening, and said notches fitting over the upper and lower surfaces of the ring so as to support said crowd plates vertically in said ring, said kelly bar extending through said ring opening between said crowd plates, said crowd plates being adapted to move horizontally toward and away from the kelly bar as the notch surfaces slide on the ring surface.

5. In a heavy duty drilling machine, a kelly bar adapted for rotation and having drilling means on its lower end, a boring head of a drilling machine adapted to receive said kelly bar therethrough and to rotate the kelly bar, a crowd frame above said boring head supported by first hydraulic rams having upper ends connected to the frame and lower ends connected to the boring head, a crowd supported vertically in said frame so as to be associated with said kelly bar, the improvement comprising:

clamping means supported by the crowd frame to engage the crowd with the kelly bar to transfer the entire weight of the drilling machine and crowd frame onto the kelly bar to increase the down pressure on the drilling means, said clamping means being adapted to disengage the crowd from the kelly bar, the crowd being adapted to remain in association with the kelly bar for drilling while being so disengaged, said clamping means including cams and cam followers, said cams being two cam rollers, each being positioned outwardly of and adjacent a respective outer follower face, said cams being supported by means including a nonrotating lower frame member of said crowd frame, and second hydraulic rams connecting said lower frame member in said crowd frame to an upper portion thereof and being adapted to move said lower frame member and said cams upwardly and downwardly, said cams being adapted to be rotated with the kelly bar, said crowd including two elongated plates extending generally vertically at opposite portions of said kelly bar, each plate being associated with a respective follower face and being adapted to be moved horizontally with the follower face, said cams being adapted to engage said follower faces in pressure contact as they are moved downwardly so as to move said elongated crowd plates horizontally into gripping engagement with said kelly bar and said cams being adapted to be disengaged from said follower faces as they are moved upwardly so as to free said crowd plates from said kelly bar, said crowd plates being supported vertically adjacent an upper end of said crowd frame on a horizontal ring having a centrally positioned rectangular opening therein, said ring being supported for rotation on horizontally mounted rollers, said rollers being supported on fixed horizontal shafts on said crowd frame outwardly of said ring, the rollers making supporting contact with the ring on horizontal surfaces thereof adjacent its circumference, said crowd plates having notches in opposite edges thereof adjacent their upper ends, said crowd plates extending through said ring opening, and said notches fitting over the upper and lower surfaces of the ring so as to support said crowd plates vertically in said ring, said kelly bar extending through said ring opening between said crowd plates, said crowd plates being adapted to move horizontally toward and away from the kelly bar as the notch surfaces slide on the ring surface.

6. In a heavy duty drilling machine, a kelly bar adapted for rotation and having drilling means on its lower end, a boring head of a drilling machine adapted to receive said kelly bar therethrough and to rotate the kelly bar, a crowd frame above said boring head supported by first hydraulic rams having upper ends connected to the frame and lower ends connected to the boring head, a crowd supported vertically in said frame so as to be associated with said kelly bar, the improvement comprising:

clamping means supported by the crowd frame to engage the crowd with the kelly bar to transfer the entire weight of the drilling machine and crowd frame onto the kelly bar to increase the down pressure on the drilling means, said clamping means being adapted to disengage the crowd from the kelly bar, the crowd being adapted to remain in association with the kelly bar for drilling while being so disengaged, said clamping means including cams and cam followers, said cams being two cam rollers, each being positioned outwardly of and adjacent a respective outer follower face, said cams being supported by means including a nonrotating lower frame member of said crowd frame, second hydraulic rams connecting said lower frame member in said crowd frame to an upper portion thereof and being adapted to move said lower frame member and said cams upwardly and downwardly, said cams being adapted to be rotated with the kelly bar, said crowd including two elongated plates extending generally vertically at opposite portions of said kelly bar, each plate being associated with a respective follower face and being adapted to be moved horizontally with the follower face, said cams being adapted to engage said follower faces in pressure contact as they are moved downwardly so as to move said elongated crowd plates horizontally into gripping engagement with said kelly bar and said cams being adapted to be disengaged from said follower faces as they are moved upwardly so as to free said crowd plates from said kelly bar, said lower frame member including a nonrotating horizontally disposed ring plate having a cylindrical opening therethrough, said second rams being connected at their lower ends to said ring plate, roller supports depending from said ring plate, inwardly extending horizontally mounted rollers having shafts fixed in said roller supports, said means including comprising a rotatable horizontal drum below said ring plate and having a central opening therethrough aligned with said cylindrical opening in said ring plate, said kelly bar extending through said last openings, and upper and lower horizontal cylindrical flanges forming circumferential marginal portions of said drum, said inwardly extending rollers being between said flanges to vertically support said drum for horizontal rotation, the extension and retraction of said second rams being adapted to respectively lower and raise said drum and said cams to respectively move said crowd plates into gripping engagement with said kelly bar and to free said crowd plates from said kelly bar.

7. The invention according to claim 6 in which:

said means including further comprising a pair of horizontally spaced vertical plates secured to said drum to move vertically and rotate horizontally therewith, said kelly bar extending between and adjacent said vertical plates, said cams being between said vertical plates and horizontally mounted therein, said cam followers and crowd plates being between said vertical plates.

8. The invention according to claim 7 in which:

said vertical plates have vertical centering extensions on both sides of said kelly bar.

9. The invention according to claim 7 in which:

said ring plate has circumferentially spaced, vertically mounted rollers depending therefrom and extending radially inwardly below said cylindrical opening to rotate on the circumference of said upper flange of said drum when it rotates.

10. In a heavy duty drilling machine, a kelly bar adapted for rotation and having drilling means on its lower end, a boring head of a drilling machine adapted to receive said kelly bar therethrough and to rotate the kelly bar, a crowd frame above said boring head supported by first hydraulic rams having upper ends connected to the frame and lower ends connected to the boring head, a crowd supported vertically in said frame so as to be associated with said kelly bar, the improvement comprising:

means supported by the crowd frame to engage the crowd with the kelly bar to transfer the entire weight of the drilling machine and crowd frame onto the kelly bar to increase the down pressure on the drilling means, said means to engage being adapted to disengage the crowd from the kelly bar, the crowd being adapted to remain in association with the kelly bar for drilling while being so disengaged, a stabilizing device to prevent twisting of the crowd frame from rotation of the kelly bar therein, said device having a pair of first spaced, generally parallel upwardly extending members being connected at lower ends thereof to said boring head, each of said pair being connected to said boring head below respective opposite ends of said crowd frame, a pair of first horizontal members extending from the upper ends of said first upwardly extending members, said first horizontal members extending toward each other and outwardly of said crowd frame, said first horizontal members being joined by a third horizontal member below and outwardly of said crowd frame, a third upwardly extending member connected to said third horizontal member, and extending upwardly therefrom, and a horizontal extension of said crowd frame having a vertically extending opening therein generally above said third horizontal member, said third upwardly extending member being slidably engaged in said vertical opening.

11. The invention according to claim 10 in which:

said first pair of upwardly extending members being pivotally connected to said boring head.

12. The invention according to claim 10 in which:

said third upwardly extending member is a rectangular rod, said vertical opening being rectangular to fit said rod.

13. The invention according to claim 12 including:

a pair of horizontally mounted rollers secured to said horizontal extension, said rollers being spaced and overlapping said vertical opening so as to engage said third upwardly extending member.

14. In a heavy duty drilling machine, a kelly bar adapted for rotation and having drilling means on its lower end, a boring head of a drilling machine adapted to receive said kelly bar therethrough and to rotate the kelly bar, a crowd frame above said boring head supported by first hydraulic rams having upper ends connected to the frame and lower ends connected to the boring head, a crowd supported vertically in said frame so as to be associated with said kelly bar, the improvement comprising:

means supported by the crowd frame to engage the crowd with the kelly bar to transfer the entire weight of the drilling machine and crowd frame onto the kelly bar to increase the down pressure on the drilling means, said means to engage being adapted to disengage the crowd from the kelly bar, the crowd being adapted to remain in association with the kelly bar for drilling while being so disengaged, a stabilizing device to prevent twisting of the crowd frame from rotation of the kelly bar therein, said device having spaced upwardly extending members secured at their lower ends to said boring head, said upwardly extending members being joined at their upper ends to horizontal members, said horizontal members being connected, and a vertical member being connected to said horizontal members adjacent their connection, said crowd frame having a vertically extending opening outwardly of said kelly bar and in vertical alignment with said vertical member, said vertical member extending through said vertical opening and being in vertical slidable engagement with said crowd frame.

15. In a heavy duty drilling machine, a generally vertical kelly bar adapted for rotation and having drilling means on its lower end, said kelly bar being a rectangular prism, a boring head of a drilling machine adapted to receive said kelly bar therethrough and to rotate the kelly bar, a crowd frame above said boring head supported by first hydraulic rams having upper ends connected to the frame and lower ends connected to the boring head, a crowd supported vertically in said frame so as to be associated with said kelly bar, the improvement comprising:

means supported by the crowd frame to engage the crowd with the kelly bar to transfer the entire weight of the drilling machine and crowd frame onto the kelly bar to increase the down pressure on the drilling means, said means to engage being adapted to disengage the crowd from the kelly bar, said means to engage including cams and cam followers, said crowd including two elongated plates extending vertically on opposite sides of said prism, and being movable horizontally by said cams and cam followers, said plates being horizontally spaced from said two opposite sides when disengaged and being in gripping contact with said two opposite sides when engaged, said cam followers being two plates, each being secured to a respective said elongated plate outwardly thereof, said cam followers tapering downwardly so as to have outer faces thereof a greater horizontal distance from said elongated plates at their lower ends than at their upper ends, a stabilizing device to prevent twisting of the crowd frame from rotation of the kelly bar therein, spaced upwardly extending members secured at their lower ends to said boring head, said upwardly extending members being joined at their upper ends to horizontal members, said horizontal members being connected, and a vertical member being connected to said horizontal members adjacent their connection, said crowd frame having a vertically extending opening outwardly of said kelly bar and in vertical alignment with said vertical member, said vertical member extending through said vertical opening and being in vertical slidable engagement with said crowd frame.

16. In a heavy duty drilling machine, a generally vertical kelly bar adapted for rotation and having drilling means on its lower end, said kelly bar being a rectangular prism, a boring head of a drilling machine adapted to receive said kelly bar therethrough and to rotate the kelly bar, a crowd frame above said boring head supported by first hydraulic rams ha upper ends connected to the frame and lower ends connected to the boring head, a crowd supported vertically in said frame so as to be associated with said kelly bar, the improvement comprising:

means supported by the crowd frame to engage the crowd with the kelly bar to transfer the entire weight of the drilling machine and crowd frame onto the kelly bar to increase the down pressure on the drilling means, said means to engage being adapted to disengage the crowd from the kelly bar, said means to engage including cams and cam followers, said crowd including two elongated plates extending vertically on opposite sides of said prism, and being movable horizontally by said cams and cam followers, said plates being horizontally spaced from said two opposite sides when disengaged and being in gripping contact with said two opposite sides when engaged, said cam followers being two plates, each being secured to a respective said elongated plate outwardly thereof, said cam followers tapering downwardly so as to have outer faces thereof a greater horizontal distance from said elongated plates at their lower ends than at their upper ends, a stabilizing device to prevent twisting of the crowd frame from rotation of the kelly bar therein, said device having spaced upwardly extending members secured to said boring head, said upwardly extending members being joined to generally horizontal means above said boring head, and a vertical member being connected to said horizontal means, said crowd frame having a vertically extending opening outwardly of said kelly bar and in vertical alignment with said vertical member, said vertical member extending through said vertical opening and being in vertical slidable engagement with said crowd frame.

* * * * *